US005556287A

United States Patent [19]

Kuhn et al.

[11] Patent Number: 5,556,287

[45] Date of Patent: Sep. 17, 1996

[54] VISUAL INDICATION OF FULLY SEATED POSITION OF BOLT-DRIVEN CONNECTOR

[75] Inventors: Brent A. Kuhn, Novi; Chong H. Yi, Dearborn, both of Mich.

[73] Assignee: United Technologies Automotive, Inc., Dearborn, Mich.

[21] Appl. No.: 518,943

[22] Filed: Aug. 24, 1995

Related U.S. Application Data

[63] Continuation of Ser. No. 238,603, May 4, 1994, abandoned.

[51] Int. Cl.[6] ..... H01R 13/64

[52] U.S. Cl. ..... 439/89

[58] Field of Search ..... 439/488, 489, 439/491

[56] References Cited

U.S. PATENT DOCUMENTS 5,131,865 7/1992 Taguchi et al. ..... 439/489
5,169,336 12/1992 Taguchi ..... 439/489

*Primary Examiner*—Gary F. Paumen
*Attorney, Agent, or Firm*—William W. Habelt

[57] ABSTRACT

This invention relates to an apparatus for providing a visual indication of whether or not a connector is fully seated. The apparatus includes an overhanging lip on one half and a contrasting ring on the other connector half. When the connectors are fully engaged, the overhanging lip occludes view of the contrasting ring.

6 Claims, 3 Drawing Sheets

FIG. 1
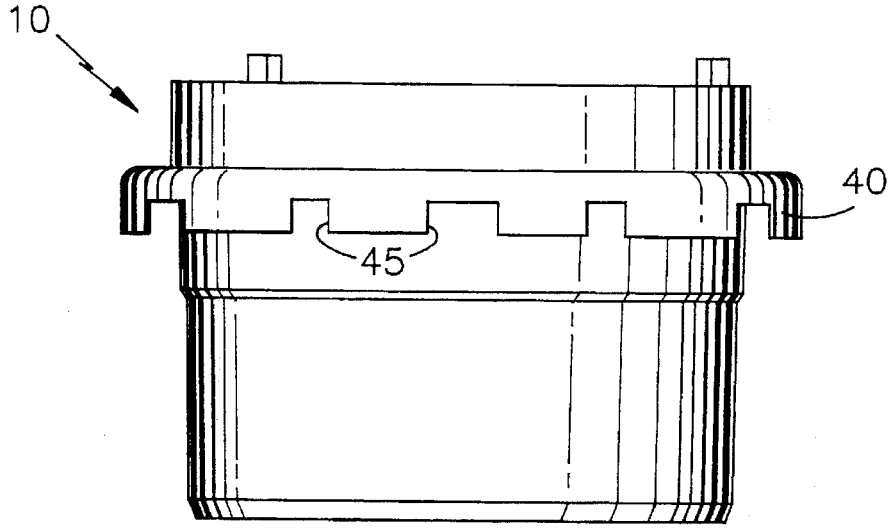
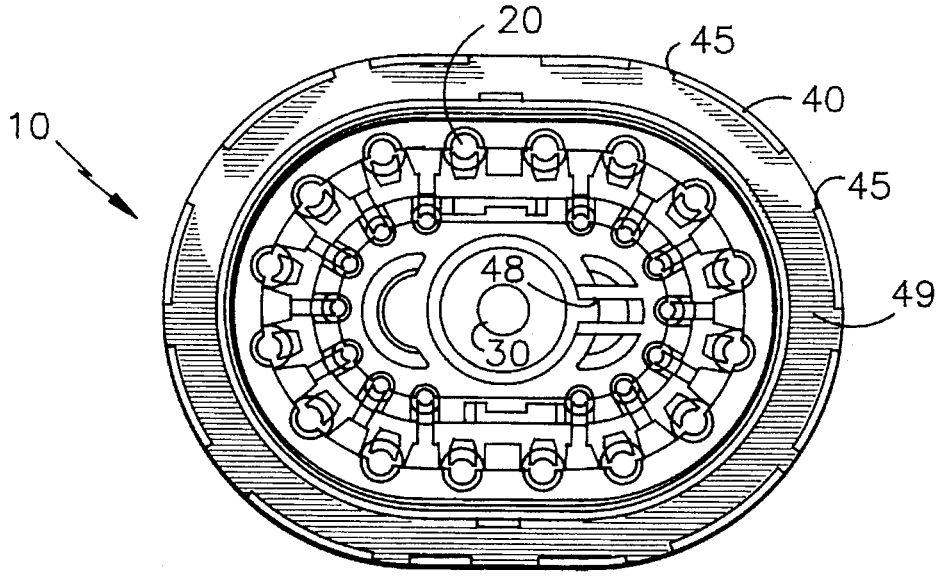
FIG. 2

FIG.3
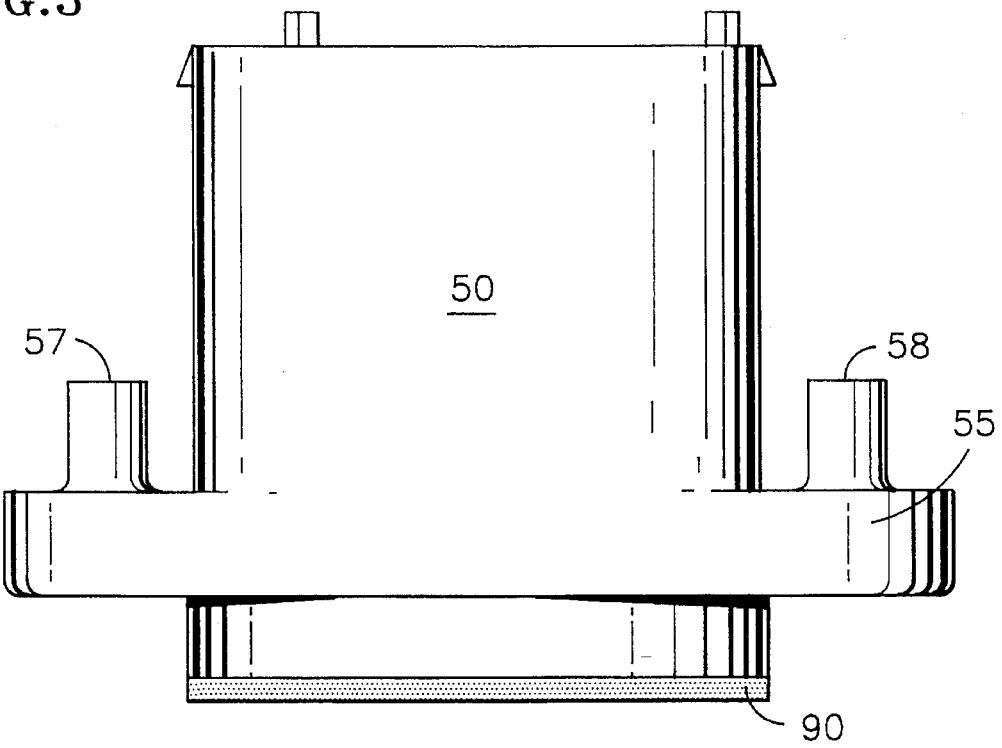
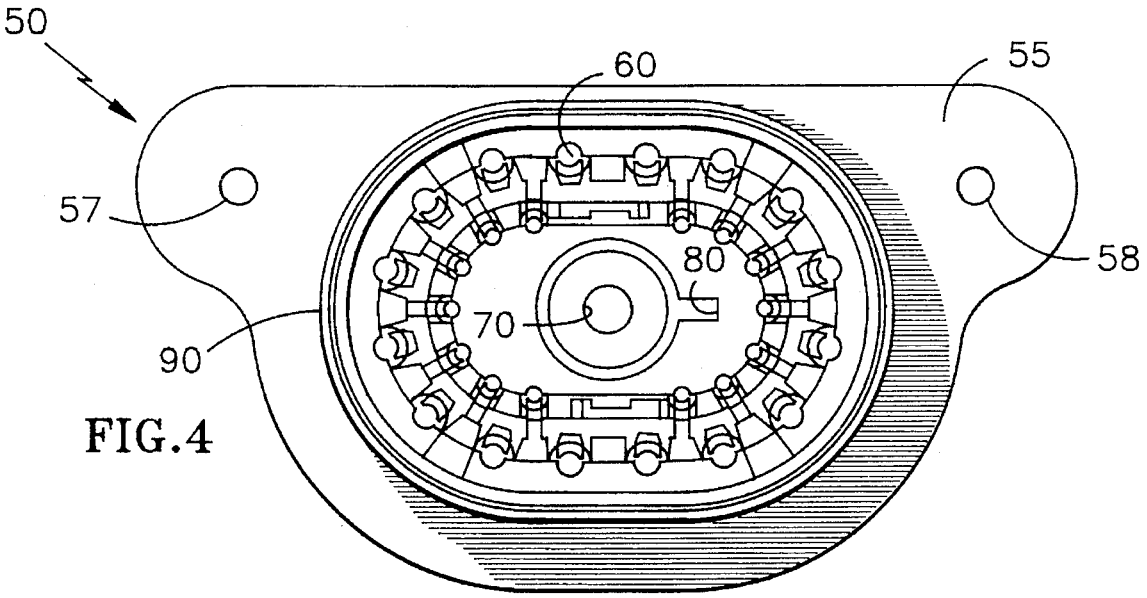
FIG.4

VISUAL INDICATION OF FULLY SEATED POSITION OF BOLT-DRIVEN CONNECTOR

This application is a continuation of application Ser. No. 08/238,603, filed May 4, 1994, now abandoned.

BACKGROUND OF THE INVENTION

1. Technical Field

This invention relates generally to connectors, and more particularly to a connector having visual means of indicating whether it is fully seated.

2. Discussion of the Related Art

In the field of wire harness assembly and installation, it is critical that all the connectors are securely seated. A poorly seated connector will result in a poor electrical connection.

Many attempts have been made over the years to ensure connectors are properly seated. For push-to-seat connectors and pull-to-seat connectors, the connector retaining clip is engaged when the connector is properly seated. However, for bolt-driven connectors, providing a retention clip is redundant. Also, when seating a bolt-driven connector, care must be taken to prevent the bolt from being overtightened. If the bolt is overtightened in an attempt to ensure the connector is fully seated, the connector may become damaged. Currently, there is no way of visually confirming if the connector is fully seated.

SUMMARY OF THE INVENTION

It is therefore an object of the present invention to provide a means for visually indicating whether a connector is fully seated. Although this embodiment is directed to bolt-driven connectors, the principles of the invention are equally applicable to other types of connectors. The invention provides for a contrasting ring encircling the mating surface of one connector, and an overlapping lip having at least one notch encircling the mating surface of the other connector. When engaged and fully seated, the mating surfaces are adjacent each other, and the overlapping lip overlaps and occludes visibility of the contrasting ring except where the notch lies. Thus, a fully seated connector can be visually confirmed by noting whether or not the contrasting ring is visible only through the notch.

One feature of the present invention is that the contrasting ring and overlapping lip are integral with their respective connectors. One advantage of the present invention is that neither the contrasting ring nor the overlapping lip require substantial modification of the connectors. These features are able to be added without requiring additional parts or adding to system cost. Another advantage is that providing the visual indicator of whether or not the connector is fully seated reduces the risk that the bolt will be overtightened in an effort to ensure the connector is fully seated.

BRIEF DESCRIPTION OF THE DRAWINGS

Other objects, features, and advantages of the present invention may be better understood by referencing the following description of the presently preferred embodiment and the drawings in which:

FIG. 1 is a side view of the female connector, showing the overlapping lip;

FIG. 2 is a top view of the female connector;

FIG. 3 is a side view of the male connector, showing the contrasting ring;

FIG. 4 is a top view of the male connector;

DETAILED DESCRIPTION OF THE PRESENTLY PREFERRED EMBODIMENT

Figure 5:
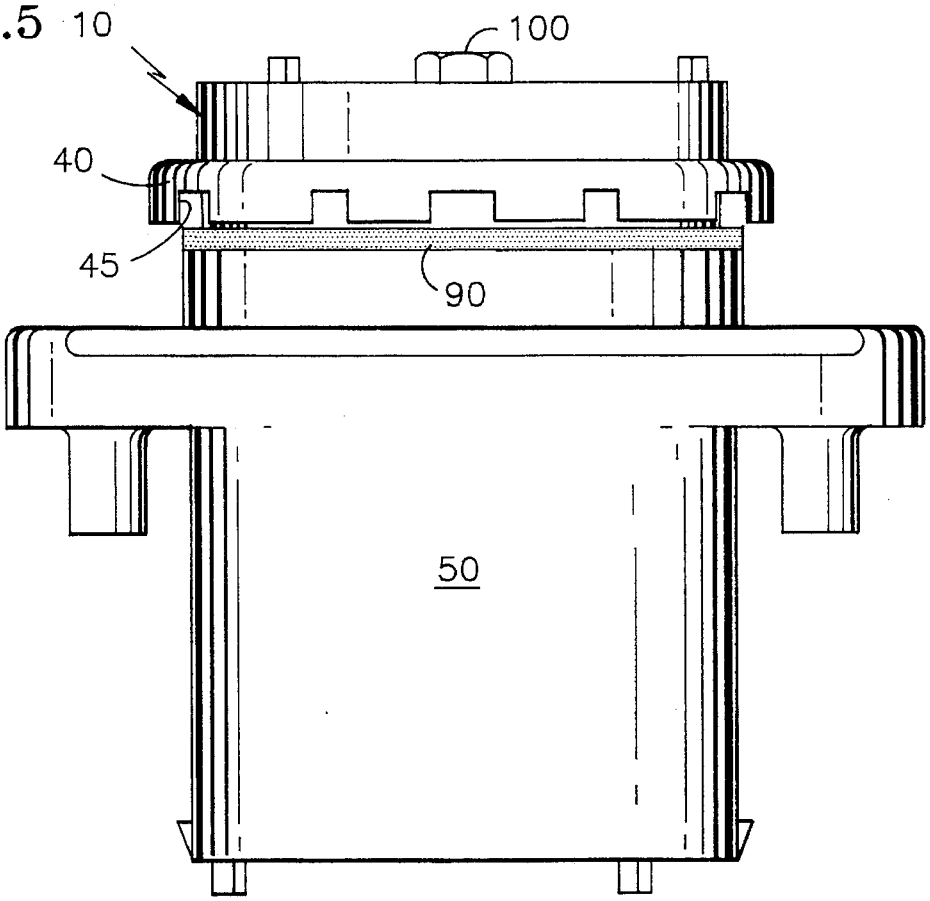
FIG. 5 is a side view showing the two connector halves engaged but not fully seated.

As shown in FIGS. 1 and 2, the female connector 10 in this embodiment is oval, and has a number of terminal cavities 20. Terminals within these cavities are connected to wires, as may be readily understood by one of ordinary skill in the art despite not being specifically illustrated in the drawings. In the center of the connector 10 is a bolt hole 30. The bolt hole 30 is approximately 6 mm in diameter and smooth bored. About the circumference of the connector 10 is an overhanging lip 40. As shown here, the lip 40 has twelve notches 45 formed along the lip. The connector 10 also has a key way 48 which helps prevent the male and female connectors from being misaligned when mating. The overhanging lip 40 is formed as an extension of the mating face surface 49.

The male connector 50, shown in FIGS. 3 and 4, includes a mounting flange 55 with two bossed mounting holes 57, 58. Like the female connector 10, the male connector 50 is oval and has a number of terminal cavities 60. In the center of the connector is a bolt hole 70. This bolt hole, like the bolt hole 30 in the female connector 10, is approximately 6 mm in diameter. However, here, the bolt hole 70 is threaded rather than smooth bored. The threads in the bolt hole engage the threads of the connector bolt (not shown) to secure the bolt within the hole. Here, the connector 50 has a brass bushing press fit into the body of the connector, where the brass bushing has the threads. Using a metal bushing reduces the likelihood that the threads will strip if overtightened. The male connector 50 has a key boss 80 which matches the shape of the key way 48 in the female connector. About the circumference of the connector 50 is a contrasting color ring 90. In this embodiment, the connector is formed from black rigid plastic, and the ring 90 is white rigid plastic.

Figure 6:
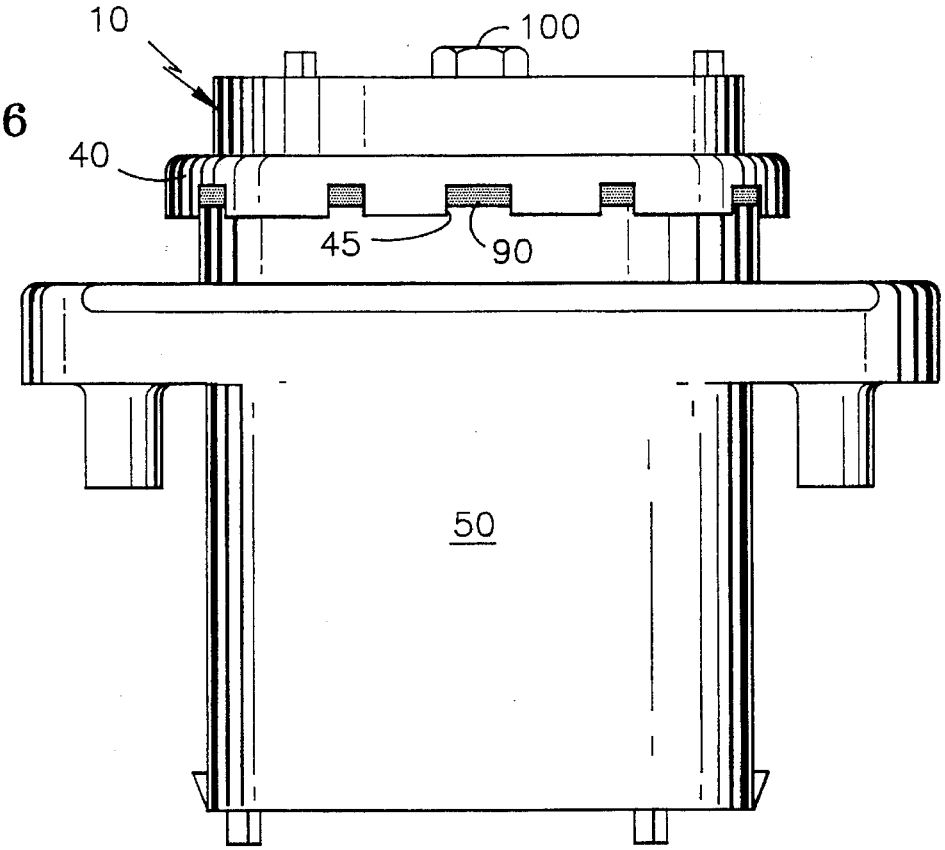
FIG. 6 is a side view showing the connectors engaged and fully seated.

As shown in FIG. 5, the two connectors 10, 50 are engaged to complete an electrical connection. Recall that the male connector 50 has a key boss 80 and the female connector 10 has a key way 48. Once the key boss 80 and key way 48 are properly aligned, the two connector halves can be mated. To secure the male 50 and female 10 connectors to each other, a bolt 100 is inserted through bolt hole 30 in the female connector 10 and is snugged in the threads of the male connector bolt hole 70. As shown here, the connectors are not fully seated. This condition can be visually confirmed by noting that the contrasting ring 90 is still visible, and has not been overlapped by the overhanging lip 40. When not fully seated, the terminals in the terminal cavities 20 in the female connector 10 may not be properly engaged by the terminals in the terminal cavities 60 of the male connector 50, resulting in a poor electrical connection. Therefore, the assembly worker engaging the connectors needs to continue snugging the bolt 100 until the connectors are fully seated, as shown in FIG. 6. Here, there is visual confirmation that the connectors are properly seated because the contrasting ring 90 is occluded by the overhanging lip 40, and is visible only through the notches 45.

It should be appreciated that, as shown in FIG. 6, the notches 45 in the overhanging lip 40 are approximately 2 mm in depth, while the contrasting ring 90 is approximately 1 mm thick. This means that the contrasting ring 90 will be occluded by the overhanging lip 40 when the female and male connectors are within 1 mm of being fully seated. When fully seated, the contrasting ring 90 rests against the mating surface 49 of the overhanging lip 40. Here, the terminals in the terminal cavities 20, 60 are deemed to be fully seated as long as the contrasting ring 90 is occluded. Thus, the connectors 10, 50 need not be fully seated and need only be fully engaged to ensure a proper electrical connection.

It should be understood that this description has been provided for the purposes of illustrating the presently preferred embodiment. In no way should this description be construed as limiting the scope of the invention. Rather, one of ordinary skill in the art could adapt this invention to suit other applications without departing from the spirit of the invention described here.

We claim:

1. An electrical connector having a visual indication of whether or not an electrical connector is fully seated, comprising:

a first connector half, said first connector half having a first mating face surface, said first connector half further having an overhanging lip extending from the first mating face surface, said overhanging lip having a color; and a second connector half, said second connector half having a second mating face surface, said second connector half having a color, said first and second mating face surfaces adapted to rest near each other when said first and second connector halves are engaged to each other, said second connector half further having a visually distinct portion along at least a portion of a circumference of said second mating face surface, said visually distinct portion having a color visually distinct from said color of said overhanging lip and visually distinct from said color of said second connector half, said overhanging lip occluding view of said visually distinct portion when said first and second connector halves are engaged and fully seated.

2. An electrical connector as set forth in claim 1 wherein said overhanging lip further includes at least one notch, said overhanging lip occluding view of said visually distinct portion except at said notch when said first and second connector halves are engaged and fully seated.

3. An electrical connector as set forth in claim 1 wherein said overhanging lip extends the circumference around said first mating face surface, and wherein said overhanging lip has at least one notch formed therein, and wherein said visually distinct portion extends the circumference around said second mating face surface, wherein said overhanging lip occludes view of said visually distinct portion except at said notch when said first and second connector halves are engaged and fully seated.

4. An electrical connector as set forth in claim 2 wherein said overhanging lip extends the circumference around said first mating face surface, and wherein said visually distinct portion extends the circumference around said second mating face surface.

5. An electrical connector as set forth in claim 1, wherein:

said color of said overhanging lip is a first color;

said color of said second connector half is a second color, said second color being visually distinct from said first color; and said color of said visually distinct portion is a third color, said third color being visually distinct from said first color and said third color being visually distinct from said second color.

6. An electrical connector as set forth in claim 1, wherein:

said color of said overhanging lip is a first color;

said color of said second connector half is said first color; and said color of said visually distinct portion is a second color, said second color being visually distinct from said first color.

* * * * *